US008491357B2

(12) United States Patent
Hessbrueggen

(10) Patent No.: US 8,491,357 B2
(45) Date of Patent: Jul. 23, 2013

(54) METHOD AND APPARATUS FOR MACHINING CRANKSHAFTS

(75) Inventor: Norbert Hessbrueggen, Salach (DE)

(73) Assignee: Emag Holding GmbH, Salach (DE)

( * ) Notice: Subject to any disclaimer, the term of this patent is extended or adjusted under 35 U.S.C. 154(b) by 486 days.

(21) Appl. No.: 12/777,294

(22) Filed: May 11, 2010

(65) Prior Publication Data

US 2010/0291837 A1 Nov. 18, 2010

(30) Foreign Application Priority Data

May 18, 2009 (DE) ..... 10 2009 021 803

(51) Int. Cl.
*B24B 5/00* (2006.01)

(52) U.S. Cl.
USPC ..... 451/399; 279/5

(58) Field of Classification Search
USPC .. 451/5, 11, 246, 249, 399, 6; 700/164; 29/27 C, 27 R; 82/151, 173, 903; 279/5, 6, 132, 279/133
See application file for complete search history.

(56) References Cited

U.S. PATENT DOCUMENTS 1,453,572 A * 5/1923 Stoner ..... 451/399
1,514,580 A * 11/1924 Floeter ..... 82/165
2,233,310 A * 2/1941 Groene et al. ..... 82/165
2,950,586 A * 8/1960 Smith ..... 451/399
3,006,118 A * 10/1961 Fournier ..... 451/399
3,009,374 A * 11/1961 Foreman ..... 82/150
3,034,268 A * 5/1962 Smith ..... 451/399
3,142,941 A * 8/1964 Fournier et al. ..... 451/25
3,357,711 A * 12/1967 Fischer ..... 279/6
3,404,492 A * 10/1968 Fournier ..... 451/399
3,583,108 A * 6/1971 Oishi et al. ..... 451/399
3,680,876 A * 8/1972 Okada ..... 279/5
3,685,845 A * 8/1972 Fischer et al. ..... 279/5
4,215,962 A * 8/1980 Kreucher ..... 409/241
4,250,667 A * 2/1981 Favrot ..... 451/399
4,326,323 A * 4/1982 Kralowetz et al. ..... 29/6.01
5,025,689 A * 6/1991 Mayer ..... 82/106
5,144,772 A * 9/1992 Kawamata et al. ..... 451/5
5,148,232 A * 9/1992 Duey et al. ..... 356/141.3
5,275,072 A * 1/1994 Schmid et al. ..... 82/164
5,544,556 A * 8/1996 Jones ..... 82/1.11
5,700,186 A * 12/1997 Hykes et al. ..... 451/406

(Continued)

FOREIGN PATENT DOCUMENTS

DE 102006011057 A 9/2007
JP 08-011001 * 1/1996

*Primary Examiner* — Joseph J Hail
*Assistant Examiner* — Joel Crandall
(74) *Attorney, Agent, or Firm* — Andrew Wilford

(57) ABSTRACT

A crankshaft is machined by first securing it in first and second radially displaceable grippers of first and second holders rotatable about a common grinding axis and orienting the workpiece axis coaxial with the grinding axis. Then the crankshaft is released from the first gripper, and the second holder is rotated to align the first crankpin radially with the grinding axis. Subsequently the crankshaft is regripped by the first gripper and released by the second gripper and the second holder is rotated relative to the crankshaft until the second holder is aligned with its displacement direction lying in a common plane with the grinding axis and the displacement direction of the first gripper. Finally, both the grippers are shifted parallel to each other in their displacement directions to center the first crankpin on the grinding axis, and the crankshaft is about the grinding axis while machining the first crankpin.

4 Claims, 3 Drawing Sheets

U.S. PATENT DOCUMENTS 6,026,549 A * 2/2000 Makino et al. ..... 29/27 R
6,578,456 B2 * 6/2003 Ragab ..... 82/120
6,672,184 B2 * 1/2004 Ogawa et al. ..... 82/106
2006/0121830 A1 * 6/2006 Hori et al. ..... 451/11

* cited by examiner

METHOD AND APPARATUS FOR MACHINING CRANKSHAFTS

FIELD OF THE INVENTION

The present invention relates to crankshafts. More particularly this invention concerns a method of and apparatus for grinding main bearings and crankpins of a crankshaft.

BACKGROUND OF THE INVENTION

A typical crankshaft has main bearings at its end, and in some cases in the middle that lie on and define a main crankshaft or workpiece axis. It also has a number of crankpins angularly equispaced about and from the main axis, for example six in two arrays of three. Each crankpin is therefore centered on an axis that extends parallel to but is radially offset from the main workpiece axis. Such a workpiece is cast and is then finished machined to very high tolerances. While the finished workpiece must meet very tight tolerances, such crankshafts are produced in large numbers and must be manufactured as rapidly and cost-efficiently as possible, which means that any manual handling must be minimized or eliminated.

Grinding the main bearings is relatively easy since the workpiece can be chucked at one end and rotated about its axis while grinding stones or other machining tools do the required finish work. For grinding the crankpins, the workpiece must rotated about the axis of the crankpin or crankpins being machined.

To this end the workpiece can be held in a pair of chucks such as described in DE 10 2006 011 057 that chucks having an outer part adapted to be rotated about an axis and a core part that can be shifted in a displacement direction radially of and orthogonal to this axis. Thus it is possible to hold a crankshaft between two such chucks and, by various manipulations, either orient the main-bearing axes or the crankpin axes concentric with the chuck axis, which here is also the so-called grinding axis on which the grinding tools are centered. Such a system does make it possible to machine a crankshaft without having to completely dechuck and rechuck it for each grinding operation, it still entails a number of complex manual setup operations.

OBJECTS OF THE INVENTION

It is therefore an object of the present invention to provide an improved method and apparatus for machining crankshafts.

Another object is the provision of such an improved method and apparatus for machining crankshafts that overcomes the above-given disadvantages, in particular that allows all the crankpins of a crankshaft to be ground, one after the other, in a totally automatic manner.

SUMMARY OF THE INVENTION

A crankshaft having at least one main-bearing surface centered on a workpiece axis and first and second crankpin surfaces centered on respective crankpin axes parallel to but offset from the workpiece axis and angularly offset from each other is machined has according to the invention by first securing the crankshaft at its ends in respective first and second radially displaceable grippers of first and second holders rotatable about a common grinding axis and orienting the first and second grippers such that the workpiece axis is coaxial with the grinding axis. Then the crankshaft is released from the first gripper, and, while gripping it with the second gripper, the second holder is rotated with the crankshaft to align the first crankpin in a radial displacement direction of the first gripper with the grinding axis. Subsequently the crankshaft is regripped by the first gripper and released by the second gripper and the second holder is rotated relative to the crankshaft until the second holder is aligned with its displacement direction lying in a common plane with the grinding axis and the displacement direction of the first gripper. Finally, both the grippers are shifted parallel to each other in their displacement directions to center the first crankpin on the grinding axis, and the crankshaft is about the grinding axis while machining the first crankpin.

Thus with this system the machine is programmed so that to center a crankpin, or several axially aligned crankpins, on the grinding axis, the crankshaft is first oriented by the chucks with its main axis, namely the axis defined by its main bearings, on the grinding axis. In this position one chuck is released and the other rotates until the camshaft is angularly oriented in the one chuck with the axis of the crankpin to be ground in a position from which it can be moved by the respective gripper into coaxiality with the workpiece axis. Once this angular orientation of the crankshaft is attained, the one chuck regrips the crankshaft and the other chuck moves into a position with its displacement direction aligned with that of the one chuck, and it regrips the workpiece. In this position it is easy to move the camshaft into a position with the crankpin to be ground centered on the workpiece axis. These steps are easy to program, since the crankpins almost invariably are angularly equispaced about the axis, so that once the crankshaft is set up initially in the grinder, all its journals can be ground automatically.

The instant invention is thus also a method of operating a crankshaft-machining apparatus having first and second holders spaced apart along and rotatable about a grinding axis and having respective first and second grippers shiftable in respective displacement directions substantially orthogonal to the grinding axis and at least one grinder. This method thus, as described above, comprises the steps of sequentially a) securing the crankshaft at its ends in the first and second grippers, b) orienting the first and second grippers such that the workpiece axis of the crankshaft they grip is coaxial with the grinding axis, c) with the crankshaft released from the first gripper, rotating the second holder and the crankshaft it is gripping to align the first crankpin in the radial displacement direction of the first holder with the grinding axis, d) regripping the crankshaft with the first gripper, e) releasing the crankshaft from the second gripper and rotating the second holder until its displacement direction is in a common plane with the grinding axis and the displacement direction of the one gripper, f) shifting the first and second grippers in their displacement directions to center the first crankpin on the grinding axis, and g) rotating the crankshaft about the grinding axis while engaging it with the grinder and machining the first crankpin.

The apparatus according to the invention thus has control means connected to the drive means, grippers, and grinder for carrying out steps a) through g) outlined immediately above.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
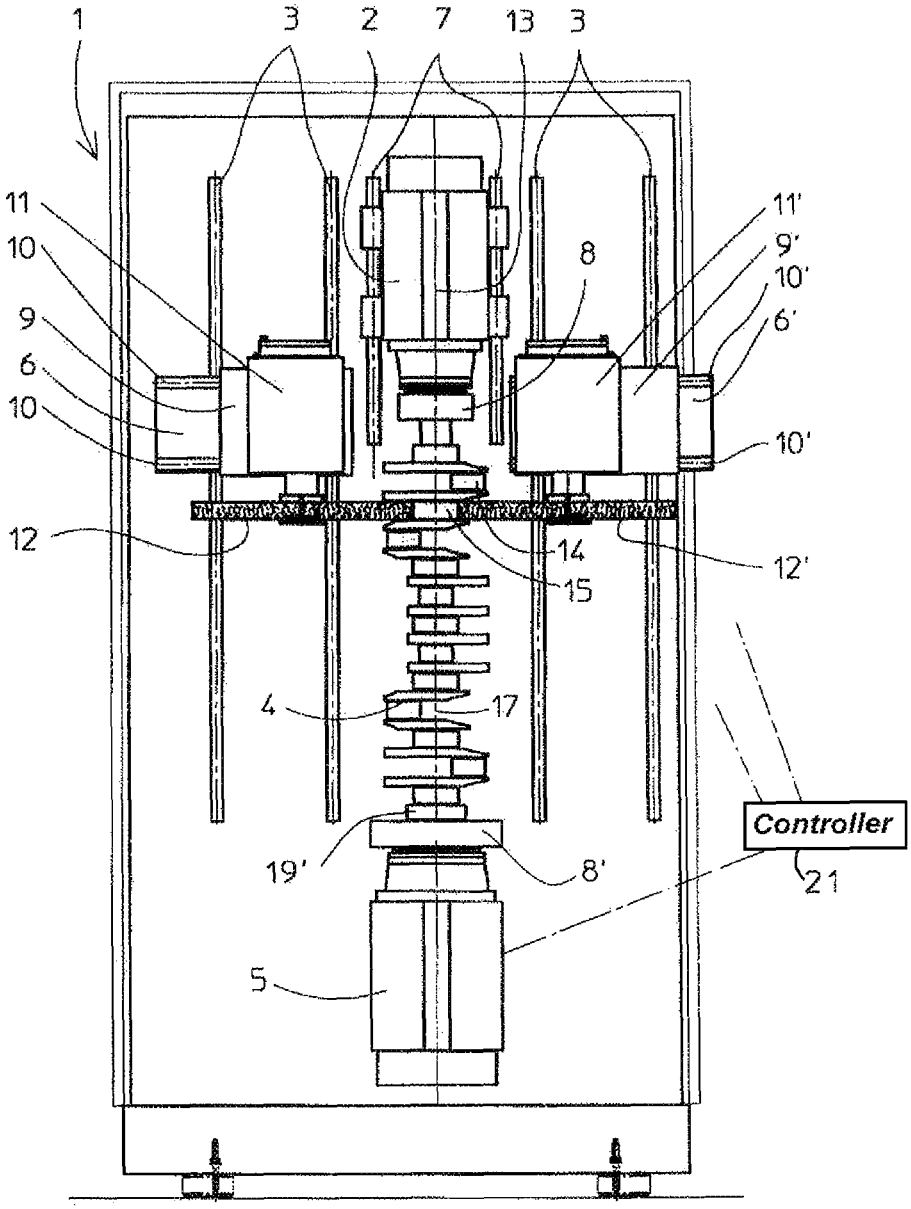
FIG. 1 is a partly schematic small-scale side view showing the grinding machine set up to machine one of the main bearings, that is with the workpiece axis coaxial with the grinding axis.
Figure 2:
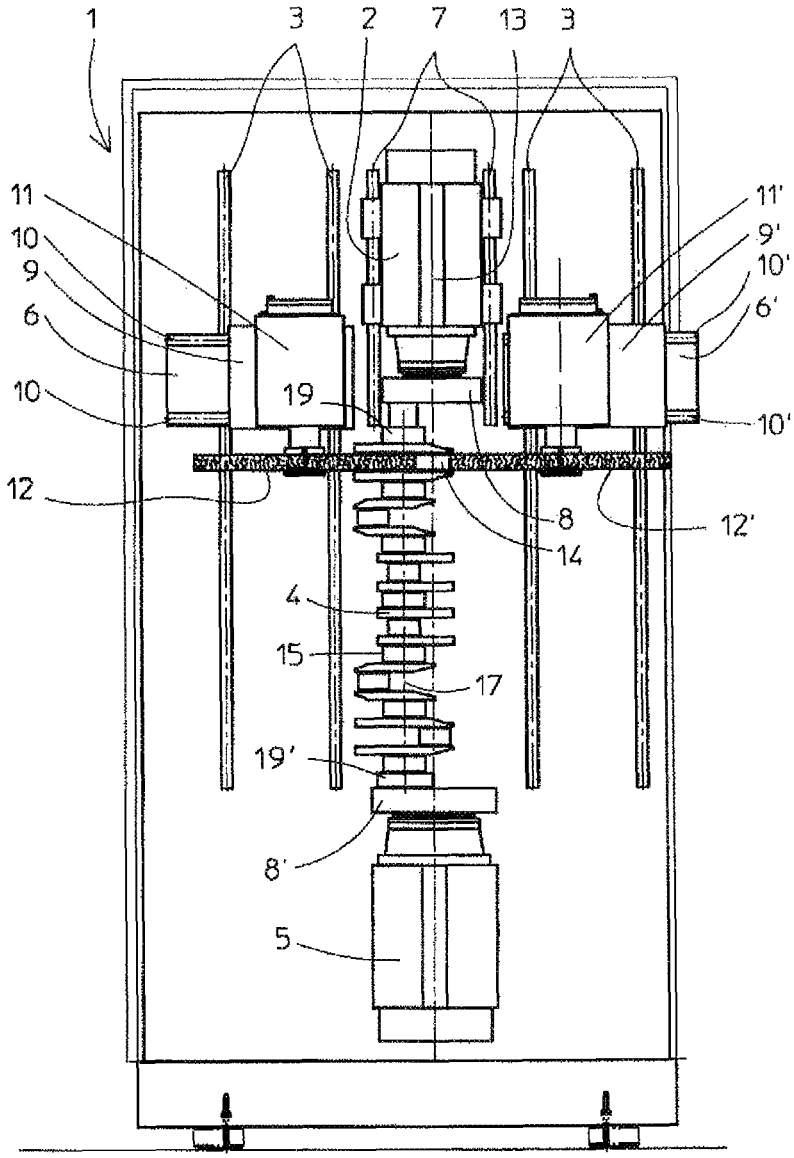
FIG. 2 shows the same view but with the machine set for grinding one of the crankpins.

As seen in FIG. 1 a grinding machine has a vertical headstock 2 at the top of a machine frame 1 and a fixed headstock 5 secured therebelow, although these parts could be different types of holders, for instance points. The headstock 2 can be moved along guides 7 in order to hold workpieces 4 of different lengths. The crankshaft 4 is itself centered on a workpiece axis 17 that passes centrally through main bearings 15. The crankshaft also has three sets of two crankpins 14, 14', and 14" angularly equispaced from and about the main axis 17. The main bearings 15 thus have cylindrical outer surfaces centered on the axis 17 and the crankpins 14, 14', and 14" have cylindrical outer surfaces centered on respective axes 20, 20', and 20" (FIGS. 3 and 4) equispaced by 120° around the axis 17. These cylindrical surfaces all must be machined to very high tolerances.

The workpiece 4 is held at its upper and lower ends in cores or grippers 19 and 19' of respective eccentric chucks 8 and 8' of the headstocks 2 and 5. These chucks 8 and 8' correspond to the chuck defined in above-identified DE 10 2006 011 057 to which reference should be made for more details, it merely being significant that the spacing between the grinding axis 13 about which the chucks 8 and 8' rotate and the axis 17 of the crankshaft 4 being held in the grippers 19 can be varied steplessly. To this end the cores 19 and 19' are shiftable in the respective chucks 8 and 8' radially of the axis 17 of the crankshaft 4 they hold.

Two grinders 11 and 11' are on opposite sides of the workpiece 4. The are movable horizontally and vertically. Respective grinding wheels 12 and 12' driven by the grinders 11, 11' are suspended below them and rotate about respective vertical axes. The grinders 11 and 11' are fixed on respective horizontal slides 9 and 9' movable by motors on respective horizontal guides 10 and 10' on respective vertical slides 6 and 6' shiftable along vertical guides 3 by motors.

Figure 3:
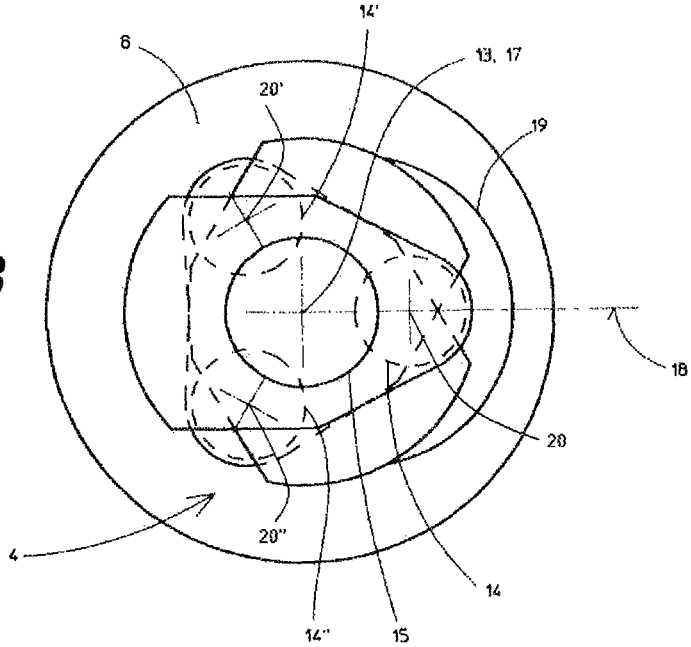
FIGS. 3 and 4 are larger-scale end views showing the crankshaft and one of the chucks in the positions of FIGS. 1 and 2, respectively.
Figure 4:
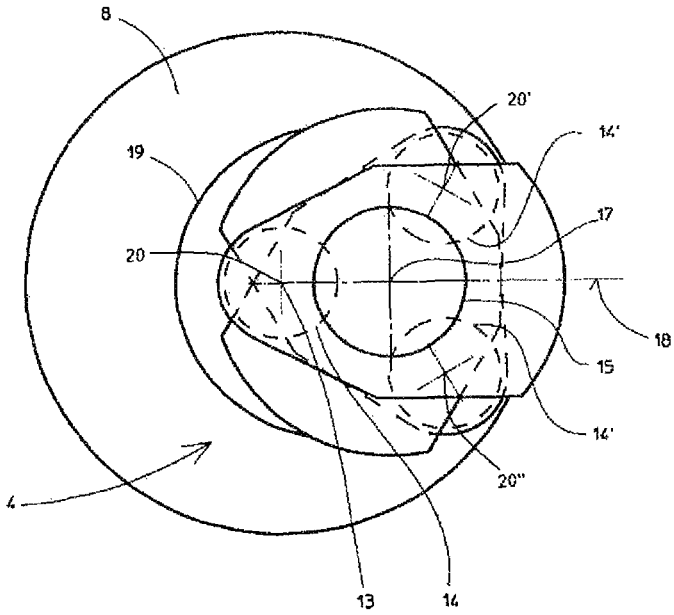

In FIG. 1 the gripper cores 19 and 19' are oriented as in FIG. 3 with the axes 13 and 17 coaxial and, therefore, the main bearings 15 centered on the grinding axis 13. In this position the grinding wheels 12 and 12' can grind the main bearings 15 while the headstocks 5 and 7 rotate the crankshaft 4 about its axis 13. A computer-type controller 21 is connected to various actuators and sensors and to the grinders 12 and 12' to operate the machine.

To machine, for instance, one of the two coaxial crankpins 14 the following steps are executed by the machine:

a) the crankshaft 4 is secured at its ends in the first and second grippers 19 and 19', b) the first and second grippers 19 and 19' are oriented such that the workpiece axis 17 of the crankshaft 4 they grip is coaxial with the grinding axis 13 as shown in FIG. 1, c) then, with the crankshaft 4 released from the first gripper 19, the second holder 8' and the crankshaft 4 it is gripping are rotated to align the first crankpin 14 in the radial displacement direction of the first holder 8 with the grinding axis 13 as shown in FIG. 3, d) the crankshaft 4 is then regripped with the first gripper 19, e) thereafter the crankshaft 4 is released by the second gripper 19' and the second holder 8' is rotated until its displacement direction 18 is in a common plane with the grinding axis 13 and the displacement direction 18 of the first gripper 8, f) the first and second grippers 19 and 19' are then shifted in their displacement directions 18 to center the first crankpin 14 on the grinding axis 13, and g) the crankshaft 4 is rotated about the grinding axis 13 while engaging the first crankpin 14 with the grinders 12 and 12' to machine the first crankpin 14.

Thereafter the grinders 12 and 12' can be stepped out and moved down to grind the other crankpin 14 that is coaxial with the one just ground.

Subsequently these steps a) through f) are repeated to grind the second crankpin(s) 14' and then again for the third crankpin(s) 14".

In this regard, it is noted that the displacement directions 18 are defined by the starting and ending points of the axes of the crankpin 14, 14' and that the crankpin axis is not necessarily moved in a straight line between its position radially spaced from the grinding axis 13 and its position coaxial therewith.

I claim:

1. A method of machining a crankshaft having at least one main-bearing surface centered on a workpiece axis and first and second crankpin surfaces centered on respective crankpin axes parallel to but offset from the workpiece axis and angularly offset from each other, the method comprising the steps of sequentially:

a) securing the crankshaft at its ends in respective first and second grippers of first and second holders rotatable about a common grinding axis, the first and second grippers being shiftable on the respective holders in respective first and second directions radial of the grinding axis;

b) orienting the first and second grippers such that the workpiece axis is coaxial with the grinding axis;

c) releasing the crankshaft from the first gripper;

d) while gripping the crankshaft with the second gripper, rotating the second holder with the crankshaft to align the first crankpin with the first radial displacement direction of the first gripper;

d') regripping the crankshaft with the first gripper;

e) while gripping the crankshaft with the first gripper, releasing the crankshaft from the second gripper and rotating the second holder relative to the crankshaft until the second holder is aligned with its second radial displacement direction lying in a common plane with the grinding axis and the first radial displacement direction of the first gripper;

e') regripping the crankshaft with the second gripper;

f) shifting both the grippers parallel to each other in their displacement directions to center the first crankpin on the grinding axis; and g) rotating the crankshaft about the grinding axis while machining the first crankpin.

2. The method defined in claim 1, further comprising the steps of:

h) repeating step b);

i) repeating steps c) through g) with the second crankpin instead of the first crankpin.

3. A method of operating an apparatus for machining a crankshaft having at least one main-bearing surface centered on a workpiece axis and first and second crankpin surfaces centered on respective crankpin axes parallel to but offset from the workpiece axis and angularly offset from each other, the apparatus having first and second holders spaced apart along and rotatable about a grinding axis and having respective first and second grippers shiftable in respective first and second displacement directions substantially orthogonal to the grinding axis, and at least one grinder, the method comprising the steps of sequentially:

a) securing the crankshaft at its ends in the first and second grippers;

b) orienting the first and second grippers such that the workpiece axis of the crankshaft they grip is coaxial with the grinding axis;

c) with the crankshaft released from the first gripper, rotating the second holder and the crankshaft it is gripping to align the first crankpin with the first radial displacement direction of the first holder;

d) regripping the crankshaft with the first gripper;

e) while holding the crankshaft with the first gripper, releasing the crankshaft from the second gripper and rotating the second holder until its second radial displacement direction is in a common plane with the grinding axis and the displacement direction of the one gripper;

e') regripping the crankshaft with the second gripper;

f) shifting the first and second grippers in their displacement directions to center the first crankpin on the grinding axis; and g) rotating the crankshaft about the grinding axis while engaging it with the grinder and machining the first crankpin.

4. An apparatus for machining a crankshaft having at least one main-bearing surface centered on a workpiece axis and first and second crankpin surfaces centered on respective crankpin axes parallel to but offset from the workpiece axis and angularly offset from each other, the apparatus comprising first and second holders spaced apart along and rotatable about a grinding axis and having respective first and second grippers shiftable in respective first and second displacement directions substantially orthogonal to the grinding axis;

respective first and drive second means for rotating the first and second holders relative to each other; and at least one grinder; and control means connected to the drive means, grippers, and grinder for:

a) securing the crankshaft at its ends in the first and second grippers, b) orienting the first and second grippers such that the workpiece axis of the crankshaft they grip is coaxial with the grinding axis, c) releasing the crankshaft from the first gripper, rotating the second holder and the crankshaft it is gripping to align the first crankpin with the first displacement direction of the first holder, d) regripping the crankshaft with the first gripper, e) while the crankshaft is gripped by the first gripper, releasing the crankshaft from the second gripper and rotating the second holder until its second displacement direction is in a common plane with the grinding axis and the displacement direction of the one gripper, e') regripping the crankshaft with the second gripper, f) shifting the first and second grippers in their respective first and second displacement directions to center the first crankpin on the grinding axis, and g) rotating the crankshaft about the grinding axis while engaging it with the grinder and machining the first crankpin.

* * * * *